US012654817B2

(12) United States Patent
Wang

(10) Patent No.: US 12,654,817 B2
(45) Date of Patent: Jun. 16, 2026

(54) PADDLE BOARD

(71) Applicant: ORIENTAL RECREATIONAL PRODUCTS (SHANGHAI) CO., LTD, Shanghai (CN)

(72) Inventor: Zhiyue Wang, Shanghai (CN)

(73) Assignee: ORIENTAL RECREATIONAL PRODUCTS (SHANGHAI) CO., LTD, Shanghai (CN)

( * ) Notice: Subject to any disclaimer, the term of this patent is extended or adjusted under 35 U.S.C. 154(b) by 457 days.

(21) Appl. No.: 18/003,032

(22) PCT Filed: Jun. 18, 2021

(86) PCT No.: PCT/CN2021/100917
§ 371 (c)(1),
(2) Date: Dec. 22, 2022

(87) PCT Pub. No.: WO2022/001700
PCT Pub. Date: Jan. 6, 2022

(65) Prior Publication Data

US 2023/0242221 A1 Aug. 3, 2023

(30) Foreign Application Priority Data

Jul. 3, 2020 (CN) ..... 202021276802.2

(51) Int. Cl.
*B63B 32/40* (2020.01)
*B63B 32/60* (2020.01)
*B63C 9/30* (2006.01)

(52) U.S. Cl.
CPC ..... *B63B 32/40* (2020.02); *B63B 32/60* (2020.02); *B63C 9/30* (2013.01)

(58) Field of Classification Search
CPC ..... B63B 32/40; B63B 32/60; B63B 32/70; B63B 32/50
See application file for complete search history.

(56) References Cited

U.S. PATENT DOCUMENTS 2,803,023 A * 8/1957 Rosenberg ..... B63C 9/30 441/127
3,022,524 A * 2/1962 Hultquist ..... B63C 9/30 441/115

(Continued)

FOREIGN PATENT DOCUMENTS

CN 202358274 8/2012
CN 204236745 4/2015

(Continued)

*Primary Examiner* — Eldon T Brockman
(74) *Attorney, Agent, or Firm* — Woods Oviatt Gilman LLP; Katherine H. McGuire, Esq.

(57) ABSTRACT

A paddle board, comprising a paddle board body (10) comprising an upper surface (11) and a lower surface (11*a*), wherein the lower surface of the paddle board body is a surface which comes into contact with the water, the upper surface of the paddle board body comprises a first region (11) and a second region (12). In the direction from the upper surface to the lower surface, the second region is lower than the first region, wherein the first region can be for the user to stand and the second region can be for user to sit. By means of the paddle board, the user can paddle when standing on the paddle board, and can also paddle when sitting on the paddle board, such that the user experience is good.

12 Claims, 2 Drawing Sheets

(56) References Cited

U.S. PATENT DOCUMENTS

| | | | | | |
|---|---|---|---|---|---|
| 3,159,854 | A * | 12/1964 | Covacevich | B63C 9/11 | 297/380 |
| 3,540,776 | A * | 11/1970 | Wilson | A47C 4/54 | 297/284.6 |
| 5,191,665 | A * | 3/1993 | Breedlove | A47C 7/021 | 5/656 |
| 9,199,702 | B2 * | 12/2015 | Cregier | B63B 34/21 | |
| 9,290,245 | B2 * | 3/2016 | Bishop | B63B 32/70 | |
| 10,214,267 | B2 * | 2/2019 | Robertson | B63B 34/21 | |
| 10,464,637 | B1 * | 11/2019 | Yakos | B63B 7/08 | |
| 2009/0078186 | A1 * | 3/2009 | Rista | B63B 34/22 | 114/345 |
| 2019/0031303 | A1 * | 1/2019 | Robertson | B63B 34/21 | |
| 2023/0242221 | A1 * | 8/2023 | Wang | B63C 9/08 | 441/65 |

FOREIGN PATENT DOCUMENTS

| | | | |
|---|---|---|---|
| CN | 106364635 | A | 2/2017 |
| CN | 207683715 | | 8/2018 |
| CN | 208993886 | | 6/2019 |
| CN | 210478966 | | 5/2020 |
| CN | 212829007 | | 3/2021 |
| DE | 202015008029 | | 1/2016 |
| FR | 3080602 | A1 | 11/2019 |
| KR | 20170031003 | | 3/2017 |

* cited by examiner

PADDLE BOARD

TECHNICAL FIELD

The application relates to the technical field of water sports, in particular to a paddle board.

BACKGROUND

At present, water sports have become an important entertainment way for people. Users use paddle boards for water sports, such as surfing and rowing. In the prior art, an upper surface of the paddle board is configured only for a user to stand or sit. That is, the user can only paddle by standing on the paddle board, or by sitting on the paddle board, which makes the existing paddle board function single and results in poor user experience.

SUMMARY

The application aims at solving the technical problems that the existing paddle board has a single function and poor user experience. The application provides a paddle board, wherein a user can not only stand on the paddle board but also sit on the paddle board, such that the use experience of the user is good.

In order to solve the above technical problems, an embodiment of the application discloses a paddle board including: a paddle board body including an upper surface and a lower surface, the lower surface of the paddle board body being a surface which comes into contact with water, and the upper surface of the paddle board body including a first region and a second region; wherein the second region is lower than the first region in a direction from the upper surface to the lower surface, the first region can be used by a user to stand, and the second region can be used by the user to sit.

With the adoption of the above technical solution, the user can not only stand on the paddle board, but also sit on the paddle board, such that the use experience of the user is good.

According to another specific implementation mode of the utility model, the second region is formed by a recess recessed in the upper surface of the paddle board body.

According to another specific implementation mode of the utility model, a bottom of the second region is provided with an inflatable cushion, and the inflatable cushion is detachably arranged at the bottom of the second region.

According to another specific implementation mode of the utility model, the inflatable cushion can serve as a life cushion when being separated from the bottom of the second region.

According to another specific implementation mode of the utility model, the paddle board further includes a clamping part arranged around the second region and arranged on the upper surface of the paddle board body for clamping a waterproof cover which can be worn by a user sitting in the second region.

According to another embodiment of the utility model, the clamping part has an annular turning edge, a gap is formed by the annular turning edge and the upper surface of the paddle board body, and the waterproof cover is provided with an annular elastic part which is elastically clamped at the gap.

According to another specific implementation mode of the utility model, the bottom of the second region is provided with a water outlet valve.

According to another specific implementation mode of the utility model, side walls of the second region are provided with handles.

According to another specific implementation mode of the utility model, the paddle board further includes a seat being detachably attached to a part, close to the second region, of the first region.

According to another specific implementation mode of the utility model, the seat is attached to the part, close to the second region, of the first region by means of a magic tape.

According to another specific implementation mode of the utility model, the first region is formed by a plane.

According to another specific implementation mode of the utility model, the first region includes a first part and a second part, and the second region is located between the first part and the second part of the first region in a length direction of the paddle board body.

According to another specific implementation mode of the utility model, the lower surface of the paddle board body is provided with at least one fin.

DETAILED DESCRIPTION

Implementation modes of the application are illustrated by specific embodiments below, and those skilled in the art can easily understand other advantages and effects of the application according to the content disclosed in the specification. Although the description of the application will be introduced in conjunction with preferred embodiments, this does not represent that the features of the application are only limited in the embodiments. On the contrary, the introduction of the application in conjunction with the implementation modes is intended to cover other alternatives or modifications that may be extended based on the claims of the application. In order to thoroughly understand the application, the following description will contain many specific details. The application may also be implemented without using these details. In addition, in order to avoid confusion or obscuring of the key point of the application, some specific details are omitted in the description. It should be noted that the following embodiments and features in the embodiments may be combined with each other under the condition of no conflict.

In order to make the objective, the technical solutions and the advantages of the present invention clearer, the implementation modes of the present invention are further described in detail in combination with the attached drawings.

Figure 1:
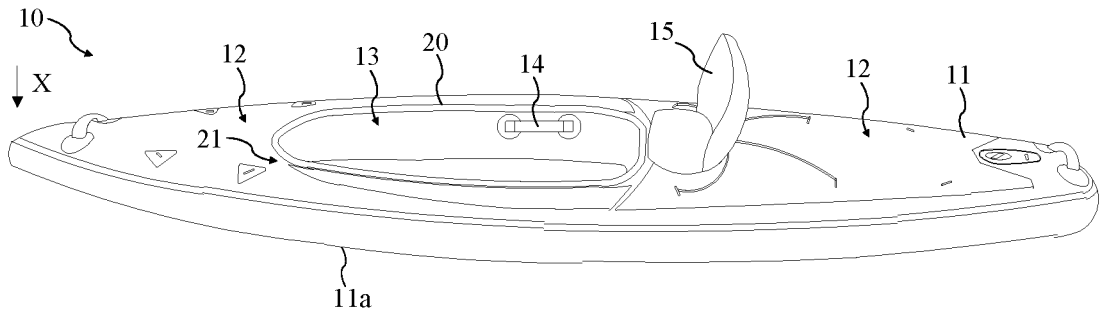
FIG. 1 shows a stereogram of a paddle board according to an embodiment of the application.
Figure 2:
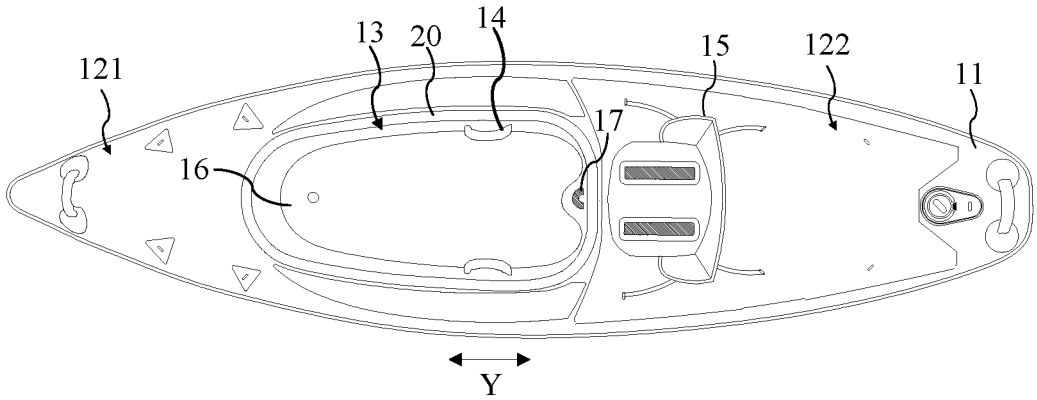
FIG. 2 shows a top view of a paddle board according to an embodiment of the application.
Figure 3:
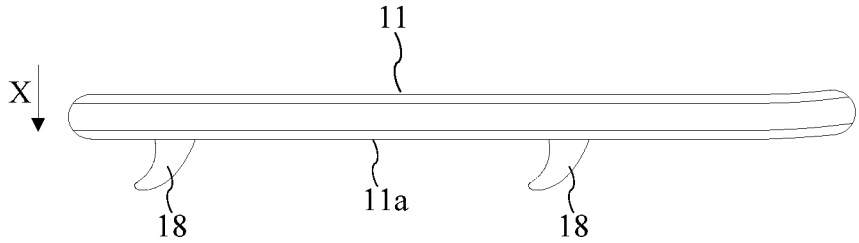
FIG. 3 shows a side view of a paddle board according to an embodiment of the application.

Referring to FIGS. 1 to 3, the application provides a paddle board including a paddle board body 10, the specific shape of which is not limited. In the embodiment, the paddle board body 10 is generally in a shuttle shape, that is, in a length direction (as shown in a Y direction in FIG. 2), the maximum width is the middle part of the paddle board body 10, and a width of the part of the paddle board body 10 extending from the middle part to two sides is gradually reduced. In the embodiment, the paddle board body 10 includes an upper surface 11 and a lower surface 11*a*, wherein the lower surface 11*a* of the paddle board body 10 is a surface which comes into contact with water, i.e., the lower surface 11*a* of the paddle board body 10 can be placed on a water surface. The lower surface 11*a* of the paddle board body 10 is provided with at least one fin 18, and two fins 18 are arranged on the lower surface 11*a* of the paddle board body 10, as shown in FIG. 3. In some possible embodiments, a corresponding number of fins 18 may be arranged according to actual needs. The fin 18 may play a guiding role when a user uses the paddle board for recreational water activities, such as paddling.

Optionally, the upper surface 11 and the lower surface 11*a* of the paddle board body 10 are made of two layers of 1000D polyester fiber reinforced PVC leather, and then are connected to form an integrated structure by up-down serial-to-parallel continuous threading, weaving and connection of uniformly distributed high-strength nylon wires. Splicing edges of the upper surface 11 and the lower surface 11*a* of the paddle board body 10 are in sealed connection by a side wall formed of a material such as polyester fiber, thereby forming an air chamber having a drawing wire support structure therein. When a drawing wire cushion is inflated, a plurality of nylon wires straighten to tighten the drawing wire support structure, thereby maintaining the shape of the drawing wire cushion stable and keeping the surface flat. Thus, the paddle board body 10 has the advantages of high strength, good resilience, and good airtightness.

Referring to FIG. 1 and FIG. 2, the upper surface 11 of the paddle board body 10 of the present application includes a first region 12 and a second region 13; wherein in a direction from the upper surface 11 to the lower surface 11*a* (as shown in an X direction in FIG. 1), the second region 13 is lower than the first region 12, wherein the first region 12 can be for a user to stand and the second region 13 can be for a user to sit. The specific sizes of the first region 12 and the second region 13 are not limited. The first region 12 is sized to allow the user to stand, and the second region 13 is sized to allow the user to sit, for example, to allow one user or two users to sit. Thus, by using the paddle board of the present application, the user can either stand on the first region 12 of the paddle board or sit on the second region 13 of the paddle board to paddle, such that the user experience is good.

Equivalently, the paddle board of the present application integrates the functions of "paddling by standing" and "paddling by sitting". For example, when a user uses a paddle board, the user chooses to stand on the first region 12 of the paddle board to paddle, or chooses to sit on the second region 13 of the paddle board to paddle. For another example, when two users use the paddle board together, one of the users chooses to stand on the first region 12 of the paddle board to paddle, and the other one of the users chooses to sit on the second region 13 of the paddle board to paddle. For another example, when two users use the paddle board together, the two users simultaneously choose to stand on the first region 12 of the paddle board to paddle, or simultaneously choose to sit on the second region 13 of the paddle board to paddle. By using the paddle board of the present application, the enjoyment of water sports for users is enhanced.

Optionally, referring to FIG. 1 and FIG. 2, the second region 13 is formed by a recess recessed in the upper surface 11 of the paddle board body 10. That is, the upper surface 11 of the paddle board body 10 is concavely provided with a recess in which a user sits to paddle.

Figure 4:
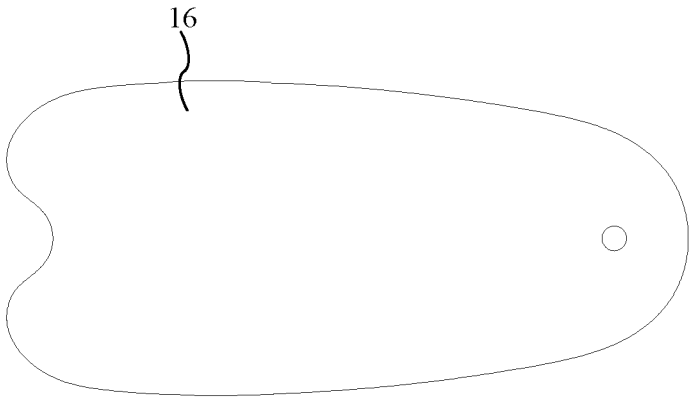
FIG. 4 shows a top view of an inflatable cushion of an paddle board according to an embodiment of the application.

Optionally, referring to FIG. 2 and FIG. 4, a bottom of the second region 13 is provided with an inflatable cushion 16, wherein the inflatable cushion 16 is detachably arranged at the bottom of the second region 13. That is, the inflatable cushion 16 is detachably arranged at a bottom of the recess. A user sits comfortably on the inflatable cushion 16.

Optionally, when the inflatable cushion 16 is separated from the bottom of the second region 13 (as shown in FIG. 4), the inflatable cushion 16 can serve as a life cushion. That is, the inflatable seat cushion 16 not only can be used by the user to sit comfortably in the second region 13, but also can be used as the life cushion for the user to use. When the user falls into water, the inflatable cushion 16 can be used to save life.

Optionally, referring to FIG. 1 and FIG. 2, the paddle board body 10 further includes a clamping part arranged around the second region 13 and arranged on the upper surface 11 of the paddle board body 10 for clamping a waterproof cover 30 which is worn by a user sitting in the second region 13. A user may wear the waterproof cover 30 to prevent water from splashing on the body when using the paddle board for water sports. The waterproof cover 30 resembles a raincoat. For example, as shown in FIG. 5, the waterproof cover 30 is provided with an outlet 32, and the user's head extends out of the outlet 32 of the waterproof cover 30 after the user wears the waterproof cover 30.

Figure 5:
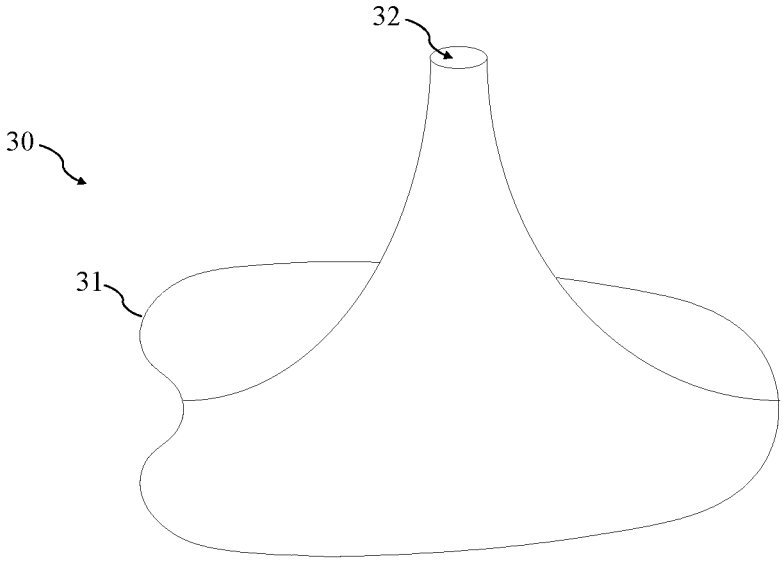
FIG. 5 shows a stereogram of a waterproof cover of a paddle board according to an embodiment of the application.

Optionally, referring to FIG. 1 and FIG. 5, the clamping part has an annular turning edge 20 which is arranged higher than the upper surface 11 of the paddle board body 10, a gap 21 is formed by the annular turning edge 20 and the upper surface 11 of the paddle board body 10, and the waterproof cover 30 is provided with an annular elastic part 31 which is elastically clamped at the gap 21. That is, after sitting in the second region 13, the user wears the waterproof cover 30, and put the annular elastic part 31 at the gap 21 formed by the annular turning edge 20 and the upper surface 11 of the paddle board body 10 in a sheathing manner to complete the installation of the waterproof cover 30 on the paddle board. The annular elastic part 31 is, for example, a rubber band.

Optionally, referring to FIG. 2, the bottom of the second region 13 of the paddle board body 10 is provided with a water outlet valve 17. When the user uses the paddle board to entertain on water for a period of time, there may be accumulated water in the second region 13 because the second region 13 is lower than the first region 12. At the moment, the water outlet valve 17 can be turned on to discharge the accumulated water in the second region 13.

Optionally, referring to FIG. 1 and FIG. 2, side walls of the second region 13 of the paddle board body 10 are provided with handles 14. When a user sits in the second region 13, the handles 14 may be held such that the user is relatively stable in the second region 13.

Optionally, referring to FIG. 1 and FIG. 2, the paddle board body 10 further includes a seat 15 which is detachably attached to a part, close to the second region 13, of the first region 12. Then, a user may sit on the seat 15 and the user's legs may be placed in the second region 13 such that the user may also sit in the first region 12 to paddle. In addition, it is more comfortable for the user to sit on the seat 15, and the enjoyment of water sports is enhanced.

The connection manner that the seat 15 is attached to the first region 12 is not limited. For example, the seat 15 is attached to the part, close to the second region 13, of the first region 12 by means of a magic tape to facilitate the assembly and disassembly of the seat 15. For another example, the seat 15 may be tied to the part, close to the second region 13, of the first region 12 by means of a strap.

Optionally, the first region 12 of the paddle board body 10 is formed by a plane. A user may stably stand on the first region 12.

Optionally, referring to FIG. 2, the first region 12 includes a first part 121 and a second part 122, and the second region 13 is located between the first part 121 and the second part 122 of the first region 12 in the length direction of the paddle board body 10 (as shown in the Y direction in FIG. 2). In one possible embodiment, three users use the paddle board together, one of the users chooses to stand on the first part 121 of the first region 12 of the paddle board to paddle, another one of the users chooses to sit on the second region 13 of the paddle board to paddle, and the other one of the users chooses to stand on the second part 122 of the first region 12 of the paddle board to paddle. The number of users using the paddle board is increased, and the enjoyment of using the paddle board by a plurality of users is enhanced, and the user experience is good.

Although the application has been illustrated and described with reference to some preferred embodiments of the application, those of ordinary skill in the art should understand that the above content is a further detailed description of the application in conjunction with the specific embodiments, and it cannot be assumed that the specific implementations of the application are limited only by these descriptions. Those skilled in the art may make various changes in forms and details, including making several simple deductions or substitutions, without departing from the spirit and scope of the application.

The invention claimed is:

1. A paddle board, comprising:

a paddle board body, including an upper surface and a lower surface, splicing edges of the upper surface and the lower surface are in sealed connection by a side wall formed of polyester fiber, thereby forming an air chamber having a drawing wire support structure therein; the lower surface of the paddle board body being a surface which comes into contact with water, the upper surface of the paddle board body including a first region and a second region;

wherein the second region is lower than the first region in a direction from the upper surface to the lower surface, and the first region can be for a user to stand and the second region can be for the user to sit;

a seat being detachably attached to a part, close to the second region, of the first region, allowing a user to sit on the seat with the user's legs placed in the second region.

2. The paddle board according to claim 1, wherein the second region is formed by a recess recessed in the upper surface of the paddle board body.

3. The paddle board according to claim 1, wherein a bottom of the second region is provided with an inflatable cushion, and the inflatable cushion is detachably arranged at the bottom of the second region.

4. The paddle board according to claim 3, wherein the inflatable cushion can serve as a life cushion when being separated from the bottom of the second region.

5. The paddle board according to claim 1, further comprising a clamping part arranged around the second region and arranged on the upper surface of the paddle board body for clamping a waterproof cover which can be worn by a user sitting in the second region.

6. The paddle board according to claim 1, wherein the waterproof cover is stowable within a gap is formed an annular turning edge and the upper surface of the paddle board body, and the waterproof cover is provided with an annular elastic part which is elastically clamped at the gap.

7. The paddle board according to claim 1, wherein the bottom of the second region is provided with a water outlet valve.

8. The paddle board according to claim 1, wherein a side wall of the second region is provided with a handle.

9. The paddle board of claim 1, wherein the seat is attached to the part, close to the second region, of the first region by means of a hook and loop fastener.

10. The paddle board according to claim 1, wherein the first region is generally planar.

11. The paddle board according to claim 1, wherein the first region includes a first part and a second part, and wherein the second region is located between the first part and the second part of the first region in a lengthwise direction of the paddle board body.

12. The paddle board according to claim 1, wherein the lower surface of the paddle board body is provided with at least one fin.

* * * * *